US007825671B2

(12) United States Patent
Horvath et al.

(10) Patent No.: US 7,825,671 B2
(45) Date of Patent: Nov. 2, 2010

(54) METHOD AND SYSTEM FOR DETERMINING THE THICKNESS OF A LAYER OF LACQUER

(75) Inventors: Zoltan-Josef Horvath, Holzgerlingen (DE); Martin Kern, Reutlingen (DE); Stephen Sindlinger, Deckenpfronn (DE); Juergen Schlecht, Walddorfhaeslach (DE)

(73) Assignee: Eisenmann Anlagenbau GmbH & Co. KG, Boeblingen (DE)

( * ) Notice: Subject to any disclaimer, the term of this patent is extended or adjusted under 35 U.S.C. 154(b) by 403 days.

(21) Appl. No.: 10/587,104

(22) PCT Filed: Dec. 4, 2004

(86) PCT No.: PCT/EP2004/013813

§ 371 (c)(1),
(2), (4) Date: Mar. 4, 2008

(87) PCT Pub. No.: WO2005/073436

PCT Pub. Date: Aug. 11, 2005

(65) Prior Publication Data

US 2008/0169829 A1 Jul. 17, 2008

(30) Foreign Application Priority Data

Jan. 22, 2004 (DE) ..... 10 2004 003 456

(51) Int. Cl.
*G01B 7/06* (2006.01)
*C25D 1/12* (2006.01)

(52) U.S. Cl. ..... 324/699; 324/229; 204/471

(58) Field of Classification Search ..... 324/699, 324/635, 644, 662; 204/471
See application file for complete search history.

(56) References Cited

U.S. PATENT DOCUMENTS

| | | | | |
|---|---|---|---|---|
| 3,492,213 | A | 1/1970 | Johnson | |
| 3,627,661 | A | 12/1971 | Gordon et al. | |
| 3,658,676 | A * | 4/1972 | De Vittorio et al. | 204/473 |
| 4,452,680 | A * | 6/1984 | Jackson et al. | 204/472 |
| 4,851,102 | A * | 7/1989 | Inoue | 204/622 |
| 5,759,371 | A * | 6/1998 | Walker et al. | 204/474 |
| 5,914,022 | A | 6/1999 | Lowry et al. | |
| 2003/0177978 | A1 * | 9/2003 | Nobutoh et al. | 118/663 |

FOREIGN PATENT DOCUMENTS

| | | |
|---|---|---|
| EP | 1270766 A2 | 1/2003 |
| GB | 293343 | 7/1928 |

(Continued)

*Primary Examiner*—Timothy J Dole
*Assistant Examiner*—Farhana Hoque
(74) *Attorney, Agent, or Firm*—Factor & Lake, Ltd.

(57) ABSTRACT

The invention relates to electrophoretic immersion lacquering of objects, e.g. the bodies of automotive vehicles, wherein the object which is to be lacquered is immersed into lacquer immersion basin containing a lacquer fluid. An electric field is produced by the object in its capacity as an electrode with at least one counter electrode. In order to determine the thickness of the lacquer layer applied in said manner, the electric charge flowing through the object during the immersion lacquering process and the surface of the object exposed to the lacquer fluid are determined in order to determine the thickness of the lacquer layer therefrom. The thickness of the lacquer coating can thus be determined during the immersion lacquering process, resulting in fewer rejects.

17 Claims, 1 Drawing Sheet

FOREIGN PATENT DOCUMENTS

| | | | |
|---|---|---|---|
| GB | 1203789 | | 9/1970 |
| JP | 63-310996 | A | 12/1988 |
| JP | 1-272795 | | 10/1989 |
| JP | 2-258998 | A | 10/1990 |
| JP | 4-165099 | A | 6/1992 |
| JP | 10237695 | A | 9/1998 |
| JP | 2000-64096 | A | 2/2000 |

* cited by examiner

METHOD AND SYSTEM FOR DETERMINING THE THICKNESS OF A LAYER OF LACQUER

CROSS-REFERENCE TO RELATED APPLICATIONS

This a national phase of International Patent Application PCT/EP2004/013813, which was filed Dec. 4, 2004, and claims benefit of Germany patent application DE 10 2004 003 456.7 filed Jan. 22, 2004. The full disclosure of these earlier applications is incorporated herein by reference.

BACKGROUND OF THE INVENTION

1. Field of the Invention

The invention relates to a method for determining the thickness of a layer of lacquer which is applied by electrophoretic immersion coating to an article, wherein the article for immersion coating is immersed in a lacquer immersion bath containing lacquer and generates an electrical field as an electrode with at least one counter electrode. The invention also relates to a system for determining the thickness of a layer of lacquer which is applied by electrophoretic immersion coating to an article, comprising an immersion bath for receiving a lacquer in which the article can be immersed, a voltage source, of which one pole can be connected to the article and of which the other pole is connected to at least one counter electrode reaching into the immersion bath.

The invention relates to a system and a method for determining the thickness of a layer of lacquer which is applied by electrophoretic immersion coating to an article.

2. Description of the Art

When lacquer coating articles it is generally important that the applied layer of lacquer has the predetermined desired thickness as precisely as possible. If the actual thickness differs excessively from the desired thickness then the quality of the lacquer coating, for example the durability or the colour effect, will usually be impaired. Excessively thickly applied layers of lacquer also lead to unnecessarily high lacquer consumption, and this should be avoided from cost and environmental perspectives.

In the case of electrophoretic lacquer coating of articles in immersion baths, it is not generally possible to ensure that the desired thickness of the layers of lacquer is maintained over a relatively long period merely by adhering to predetermined process conditions. Thus, for example, the properties of the lacquer may change over time. Contact of the article with the voltage source also frequently leads to difficulties. A loose connection in the region of the contacting area is directly reflected in a reduced layer thickness.

Previously, for quality control, the thickness of electrophoretically applied layers of lacquer has generally been determined manually, for example using a measuring microscope or a capacitive measuring device, after drying. If it is established during the course of this that the thickness of the applied layer of lacquer differs from the desired thickness beyond the tolerance limits, the faults responsible for this can be discovered and optionally eliminated. Re-coating is possible, however, in the case of excessively thin layers of lacquer, if need be after removing the dried layer of lacquer. As rejects the articles that are lacquer coated too thinly or thickly increase the production costs considerably.

For this reason it has already been proposed that the thickness of the layer of lacquer be determined directly after emergence from the lacquer immersion bath and not firstly after drying. As the lacquer has not yet cured at this point, re-coating is optionally possible by way of re-immersion in the lacquer immersion bath. The measuring devices required for this are very expensive however and lead to a loss of time and sometimes to a loss of quality if the wet lacquer coating is damaged.

The present invention is directed to resolving these and other matters.

SUMMARY OF THE INVENTION

An object of the present invention is to improve the known methods and systems for determining the thickness of an electrophoretically applied layer of lacquer in such a way that the rejection rate as a result of articles that are lacquered too thinly or thickly is reduced at low cost.

This object may be achieved by a method for determining the thickness of a layer of lacquer which is applied by electrophoretic immersion coating to an article, wherein the article for immersion coating is immersed in a lacquer immersion bath containing lacquer and generates an electrical field as an electrode with at least one counter electrode. The electrical charge flowing through the article during immersion coating and the surface of the article exposed to the lacquer are ascertained and therefrom the thickness of the layer of lacquer is determined.

The invention is based on the recognition that, despite the relatively complex procedures in the immersion bath during the electrophoretic immersion coating, the thickness of an applied layer of lacquer is proportional, at least in a first approximation, to the electrical charge flowing during immersion coating and approximately inversely proportional to the size of the total surface of the article to be coated. The two values, i.e. the total flowing electrical charge and the size of the surface of the article to be coated, may be easily determined. The invention therefore allows the layer thickness to be determined without contact virtually during the immersion coating process still. This in turn makes it possible to still re-coat the article in the case of an excessively thin lacquer coating. The rejection rate during lacquer coating is thus significantly reduced. The final inspection of the lacquer coating may also be omitted as each individual lacquer coating step can be checked directly in situ for whether the thicknesses of the lacquer layers are still within the predetermined tolerances.

With respect to the system, the above-stated object may be achieved with a system for determining the thickness of a layer of lacquer which is applied by electrophoretic immersion coating to an article, comprising an immersion bath for receiving a lacquer in which the article can be immersed, a voltage source, of which one pole can be connected to the article and of which the other pole is connected to at least one counter electrode reaching into the immersion bath. The system further comprises means for determining the electrical charge flowing through the article during immersion coating and a computer which tunes the thickness of the layer of lacquer from the charge and the surface of the article exposed to the lacquer.

The advantages of the system according to the invention analogously tally with the above-described advantages of the method according to the invention.

The simplest way of determining the electrical charge which flows through the article during immersion coating is to measure electrical current flowing though the article during immersion coating. The charge results by integrating the amperage over time.

The surface of the article may be calculated in many cases from the construction data. If a calculation of this type is difficult, however, as may be the case for example with highly fissured automotive bodies, the maximum starting current, which flows through the article at the start of immersion coating, may also be used as a measure of the surface of the article. The larger this surface is, the greater the starting current also is which flows through the article. Measuring the starting current at the start of immersion coating is advantageous as the measurements for different articles may thus be easily compared. If the amperage were to be used at a later instant as a measure of the surface of the article, the problem would result of the articles then already being coated to different thicknesses and thus being insulated to differing extents and the flowing current would thus no longer constitute an unambiguous measure of the surface of the article.

To produce a quantitive correlation between the measured charge and the surface of the article on the one hand and the layer thickness to be determined on the other hand, the system may firstly be calibrated in that a plurality of articles with different surfaces are coated over different periods. The measured values recorded in the process are then manually related to specific layer thicknesses of the articles.

However, it is also possible to set up a quantitive model for calculating the layer thicknesses. As experiments have shown, the measuring accuracy of the layer thickness measurement can be improved if, in addition to the charge and the size of the surface to be coated, further process parameters are taken into account. These process parameters are, in particular, the temperature, pH, electrical conductivity, solids content and the density of the lacquer. These parameters influence the mobility of the lacquer pigments in the electrically charged field and the concentration of other charged particles which contribute to the flow of current but not to the coating.

If the surface of the article is already known, the voltage applied between the electrode and the at least one counter electrode may be regulated in such a way that the starting current density at the start of immersion coating has a predetermined value that preferably depends on the lacquer parameters. It has been found in particular that especially good coating results may be achieved if the value crucial for the coating effect, namely the current density, has a value at the start of immersion coating which is optimally adjusted to the properties of the lacquer.

The above-described method can be used not only for the actual determination of the layer thickness but also within the framework of a controller of the electrophoretic immersion coating. The controller may, for example, be configured in such a way that the immersion coating is terminated as soon as the determined layer thickness has reached a predeterminable desired value. This makes use of the fact that even during immersion coating information on the layer thickness is available by way of the measurement of the charge that has flowed through up to a certain instant. The accumulation of the layer thickness during immersion coating can thus be continuously tracked and interrupted as soon as the desired layer thickness is reached.

It is to be understood that the aspects and objects of the present invention described above may be combinable and that other advantages and aspects of the present invention will become apparent upon reading the following description of the drawings and detailed description of the invention.

BRIEF DESCRIPTION OF THE DRAWINGS

Further features and advantages of the invention can be found in the following description of an embodiment with reference to the drawings, in which.

DETAILED DESCRIPTION OF THE PRESENT INVENTION

Figure 1:
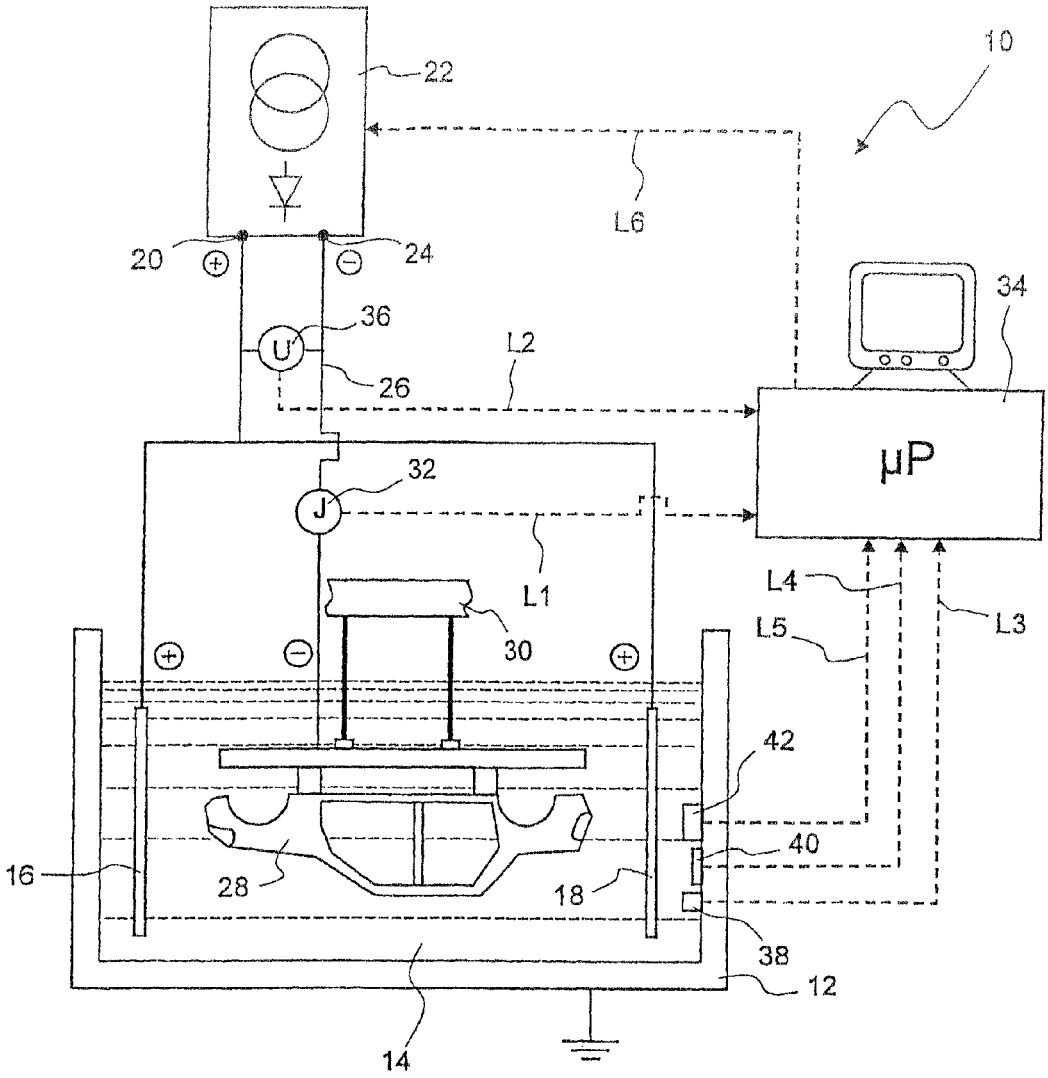
FIG. 1 shows a basic sketch of a system according to the invention for determining the layer thickness.

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

FIG. 1 schematically shows a system for determining the thickness of a cataphoretically applied layer of lacquer and designated as a whole by reference numeral 10. The system 10 comprises an earthed lacquer immersion bath 12 into which a lacquer 14 is poured. The lacquer 14 contains binders and pigments which constitute the actual constituents of the subsequent layer of lacquer. It is assumed in the illustrated embodiment that both the binders and the pigments are electrically positively charged. However, there are also lacquers 14 in which only the binder particles but not the pigments themselves are electrically charged. The lacquer 14 also contains a solvent of which the ion concentration may be determined via the pH and the electrical conductivity of the lacquer 14.

Two anode plates 16, 18 which are connected to the positive pole 20 of a coating power source 22 are arranged in the lacquer immersion bath 12. A negative pole 24 of the coating power source 22 is connected via a wire 26 to an article to be coated, which in the illustrated embodiment is a vehicle body 28. The vehicle body 28 is suspended from a conveying system 30 indicated by 30 and which is part of a superordinate conveying system of a coating line. The conveying system 30 allows the vehicle body 28 to be immersed into the lacquer immersion bath 12 and raised therefrom again once immersion coating has ended.

In a modification the anode plates 16, 18 may also be arranged in the interior of a dialysis housing.

The system 10 known in this respect also comprises an ammeter 32 with which the current flowing through the vehicle body 28 during immersion coating can be measured. In the illustrated embodiment the ammeter 32 is arranged in the wire 26 which connects the coating power source 22 to the vehicle body 28. The ammeter 32 can of course also be arranged at another location within the electric circuit or within the coating power source 22. The ammeter 32 is connected via a data line L1 to a computer 34 in which the measured amperage can be recorded over time.

The system 10 also comprises a voltmeter 36 which measures the electrical voltage between the positive pole 20 and the minus pole 24. The voltmeter 36 is also connected via a data line L2 to the computer 34.

A plurality of sensors, namely a temperature sensor 38, a pH sensor 40 and a conductivity sensor 42, which metrologically measure the corresponding values and transmit them via data lines L3, L4 and L5 to the computer 34, are arranged in the lacquer immersion bath 12.

The function of the system 10 will be described hereinafter with reference to FIG. 2

Figure 2:
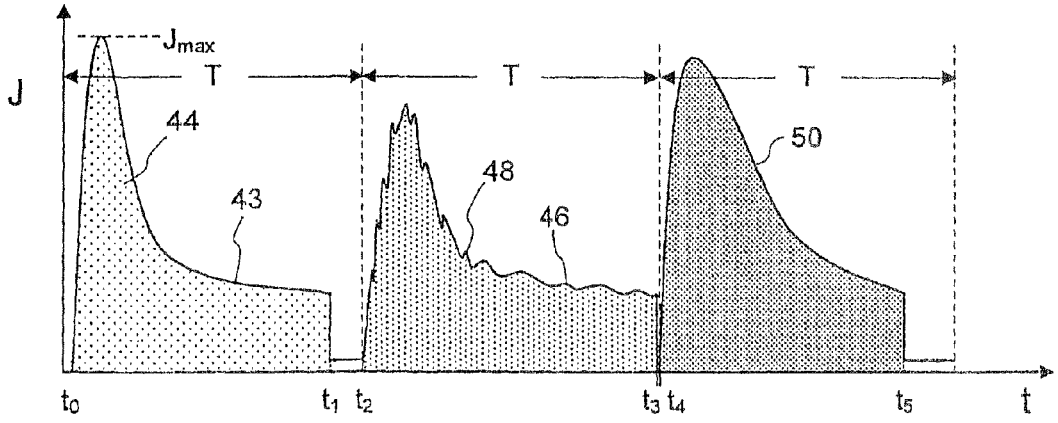
FIG. 2 shows a graph in which the current flowing during immersion coating is plotted for a plurality of articles over time.

FIG. 2 shows a graph in which the amperage J measured by the ammeter 32 for three articles coated one after the other is plotted as a function of time.

Following immersion of the vehicle body 28 in the lacquer 14 the coating power source 22 is switched on. The coating power source 22 generates a direct voltage which is in the order of magnitude of a few hundred volts. Application of this voltage to the anode plates 16, 18 and to the vehicle body 28 forming a cathode leads to the formation of an electrical field inside the lacquer 14, of which the strength depends in particular on the voltage and the spacing between the anode plates 16, 18 on the one hand and the vehicle body 28 on the other. As the pigments contained in the lacquer and binder particles are electrically positively charged, the prevailing electrical field generates electrokinetic forces which lead to depositing of the pigments and binder particles on the vehicle body 28.

As the vehicle body 28 is still uncoated at time $t_0$ when the coating power source 22 is switched on, a high starting current initially flows, of which the maximum value $J_{max}$ is a measure of the total area of the vehicle body 28 to be coated. The quantitive correlation between the maximum starting current $J_{max}$ and the area of the vehicle body 28 is determined in the process preferably by calibration. The vehicle body 28 is increasingly electrically insulated by the cataphorectic coating of the vehicle body 28 with the pigments and binder particles, so the amperage measured by the ammeter 32 quickly decreases again (cf. current curve 43 in FIG. 2). A superordinate controller switches off the coating power source 22 after a period $t_1-t_0$ to the extent that only a low residual current still flows which prevents detachment of the layer of lacquer from the article but which does not increase the layer thickness any further. At the end of the clock interval T the vehicle body 28 can be raised from the lacquer immersion bath 12 with the aid of the conveying system 30 and be fed for example to a subsequent washing station.

To determine the thickness of the coating applied during immersion coating, the computer 34 integrates the amperage measured by the ammeter 32 during the interval $t_1-t_0$. This integral, which is indicated in FIG. 2 as a dotted area 44, is equal to the total charge which has flowed though the vehicle body 28 during cataphorectic coating. If, apart from the positively charged pigments and binder particles, the lacquer 14 does not contain any further electrically charged particles, the total charge indicated by the area 44 would correspond exactly to the quantity of pigment and binder particles which have been deposited on the vehicle body 28. The lacquer does actually contain other charged particles as well, however. If, however, it may be ensured that the concentration and mobility thereof is at least approximately constant during immersion coating, there is still a direct correlation between the measured total charge on the one hand and the total quantity of pigments and binder particles which have been deposited on the vehicle body 28 during immersion coating.

The thickness of the coating which was applied cataphoretically to the vehicle body 28 during immersion coating results as the volume of deposited pigments and binder particles divided by the total surface of the vehicle body 28. It is of course assumed in this case that variations in thickness, for instance as a consequence of disturbances to the electrical field distribution, do not occur. The total area of the vehicle body 28 to be coated is determined in advance either on the basis of the construction data and supplied to the computer 34 or else is determined by the computer using the above-mentioned maximum starting current $J_{max}$, for example by using what is known as a "look-up table" in which the correlation between the starting current and the surface is stored.

Since, as already mentioned above, the correlation between the total charge flowing through the vehicle body 28 on the one hand and the quantity of depositing pigments and binder particles on the other hand only applies if the other charged particles in the lacquer are not subject to any relatively great changes with respect to concentration or mobility, the values of the temperature sensor 38, the pH sensor 40 and the conductivity sensor 42 that are relevant hereto are also transmitted to the computer 34. In addition, a density sensor and a sensor for detecting the solids content may also be provided (not shown). The provision of further sensors is also possible. If the values detected by the sensors change significantly during immersion coating, the layer thickness value may be corrected accordingly. The correction values may also be taken from a "look-up table" created during the course of calibration or else be calculated using a physical model. The electrokinetic movement of all charged particles in the lacquer 14 should be simulated in the model for this purpose.

If the computer 34 establishes that the thickness of the applied layer is outside the permissible tolerance range, different measures may be taken. If the layer has been applied too thinly for example, the conveying system 30 can leave the vehicle body 28 in the lacquer immersion bath 12 a little while longer or immerse it again and re-coat it as the lacquer coating has not yet cured at this point. The re-coated vehicle body 28 thus does not constitute a reject.

If, on the other hand, the measured layer thickness is still too thin despite prolonged coating, the vehicle body 28 is generally to be regarded as a reject. The vehicle body 28 can however be separated out of the coating line in good time.

In both cases measures may also be taken very promptly to determine possible causes for the deviations from the desired thickness, to eliminate them and save material, energy and reworking as a result.

The computer 34 may however also switch off the coating power source 22 directly via a data line L6 if the desired layer thickness has been reached. Such a procedure is particularly expedient if, for example, contacting of the articles to be lacquer coated is difficult. In this case the situation may occur where, owing to the varying electrical resistance as a result of poor contacting, quite different current curves are produced. This is shown in FIG. 2 for three articles that are identical per se. In the case of the second article, of which the current curve is designated 46, only a low overall amperage is achieved owing to poor contacting. As a result the cataphorectic coating proceeds more slowly. The computer 34 accordingly continuously records the increase in the thickness of the coating and switches off the coating power source 22 at a time $t_3$ shortly before the end of the clock interval T at which the layer of lacquer applied in the meantime has reached the desired thickness. The area 48 under the current curve 46 is thus at least approximately the same size as the area 44 below the above-described first current curve 43. In the case of even poorer contacting, the clock interval T is too short, so the article is separated out and has to be reworked later.

In the case of the third article, of which the current curve is designated 50, it is by contrast assumed that the contacting is equally as good as in the case of the first-described article with the current curve 43, but it is also assumed that the lacquer 14 has in the meantime changed to the extent that the charged pigments and binder particles have greater mobility, so the amperage decreases less quickly once immersion coating has started. The computer 34 therefore switches off the coating power source 22 earlier, so the area 52 below the current curve 50 is approximately the same size as the areas 44 and 48.

The system 10 may also be provided with a regulating device which ensures that the vehicle body 28 is always exposed to the same current density at the start of immersion coating. In detail, the voltage generated by the coating power source 22 is adjusted such that, independently of the area of the vehicle body 28, the same lacquer-specific current density results all over. Maintenance of a particular lacquer-specific current density has proven to be expedient as lacquers applied under these conditions have particularly good adhesion properties and the clock interval is independent of the size of the area to be coated.

In the case of the above-described system 10 the vehicle body 28 is cataphoretically coated. The above-described method for measuring the layer thickness may of course also be applied to systems in which an anaphoretic coating takes place. Only the polarities have to be changed for this purpose and a lacquer used in which the pigments are negatively charged rather than positively.

The system 10 may not only be clocked as described above, but may also be continuously operated. It is also possible to introduce a plurality of similar workpieces simultaneously into the lacquer immersion bath 12 on suitable goods carriers and to determine the thicknesses of the layer of lacquer applied to the workpieces in the above-described manner.

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

The invention claimed is:

1. A method for determining the thickness of a layer of lacquer which is applied by electrophoretic immersion coating to an article, wherein the article for immersion coating is immersed in a lacquer immersion bath containing lacquer and forms an electrode which generates, together with at least one counter electrode, an electrical field comprising the following steps:

a) determining the electrical charge flowing through the article during immersion coating, b) measuring the maximum starting current which flows through the article at the start of immersion coating, c) determining the surface of the article exposed to the lacquer, thereby using the maximum starting current measured in step b) as an input value, d) determining the thickness of the layer of lacquer based on the electrical charge determined in step a) and the surface determined in step c).

2. The method of claim 1, wherein the electric current flowing through the article during immersion coating is measured for determining the electric charge in step a).

3. The method of claim 1 wherein the thickness of the layer of lacquer is determined in step d) by taking into account the temperature of the lacquer.

4. The method of claim 1, wherein the thickness of the layer of lacquer is determined in step d) by taking into account the pH factor of the lacquer.

5. The method of claim 1, wherein the thickness of the layer of lacquer is determined in step d) by taking into account the electrical conductivity of the lacquer.

6. The method of claim 1, wherein the thickness of the layer of lacquer is determined in step d) by taking into account the solids content of the lacquer.

7. The method of claim 1, wherein the thickness of the layer of lacquer is determined in step d) by taking into account the density of the lacquer.

8. The method of claim 1, wherein the thickness of the layer of lacquer is determined in step d) by taking into account the spacing between the article and the at least one counter electrode.

9. The method of claim 1, wherein the predetermined value depends on parameters of the lacquer.

10. The method of claim 1, wherein the immersion coating is finished as soon as the determined layer thickness has reached a predeterminable target value.

11. A system for determining the thickness of a layer of lacquer which is applied by electrophoretic immersion coating to an article, comprising:

an immersion bath which is to receive a lacquer in which the article can be immersed, a voltage source, having a first pole, which is to be connected to the article, and a second pole, which is connected to at least one counter electrode reaching into the immersion bath, an ammeter which is to measure a current flowing through the article during immersion coating, a charge measurement apparatus which is to determine from the current measured by the ammeter the electrical charge flowing through the article during immersion coating, and, a computer which is programmed to store a maximum starting current which flows through the article at the start of immersion coating and which has been measured by the ammeter, and to determine the surface of the article exposed to the lacquer, thereby using the stored maximum starting current as an input value, and to determine the thickness of the layer of lacquer which is applied by electrophoretic immersion coating to the article, thereby using the charge measured by the charge measurement apparatus and the surface of the article as input values.

12. The system of claim 11, comprising a temperature sensor, which is connected to the computer, for determining the temperature of the lacquer.

13. The system of claim 11, comprising a pH sensor, which is connected to the computer, for measuring the pH factor of the lacquer.

14. The system of claim 11, comprising a conductivity sensor, which is connected to the computer, for measuring the conductivity of the lacquer.

15. The system of claim 11, comprising a sensor, connected to the computer, for determining the solids content of the lacquer.

16. The system of claim 11, comprising a density sensor, which is connected to the computer, for measuring the density of the lacquer.

17. The system of claim 11, comprising a controller which is configured to terminate the immersion coating as soon as the specific lacquer thickness has reached a predeterminable target value.

* * * * *